United States Patent [19]

Kesselman

[11] Patent Number: 4,815,304

[45] Date of Patent: Mar. 28, 1989

[54] MAGNETIC LOCK

[76] Inventor: David A. Kesselman, 5494 Winter Creek Rd., Santa Rosa, Calif. 95404

[21] Appl. No.: 124,260

[22] Filed: Nov. 23, 1987

[51] Int. Cl.[4] ..... E05B 67/36

[52] U.S. Cl. ..... 70/34; 70/276; 70/386

[58] Field of Search ..... 70/23, 32, 37, 34, 276, 70/386

[56] References Cited

U.S. PATENT DOCUMENTS

| | | | |
|---|---|---|---|
| 3,002,368 | 10/1961 | Moberg . | |
| 3,033,016 | 5/1962 | Moberg | 70/395 |
| 3,261,630 | 7/1966 | Chew . | |
| 3,314,708 | 4/1967 | Welch . | |
| 3,416,336 | 12/1968 | Felsa | 70/276 |
| 3,665,740 | 5/1972 | Taniyama | 70/276 |
| 3,782,147 | 1/1974 | Hallmann | 70/276 |
| 3,855,827 | 12/1974 | Hallman | 70/276 |
| 4,015,456 | 4/1977 | Moburg | 70/34 |
| 4,022,038 | 5/1977 | Miller | 70/276 |
| 4,049,313 | 9/1977 | Lundberg . | |
| 4,107,959 | 8/1978 | Skarzynski | 70/159 |
| 4,262,946 | 4/1981 | Swisher | 292/307 R |

*Primary Examiner*—Robert L. Wolfe

*Attorney, Agent, or Firm*—Sixbey, Friedman, Leedom & Ferguson

[57] ABSTRACT

A magnetic lock which may serve, itself, as a locking device, or may form part of an otherwise conventional locking device, is provided with a body member, detent balls, and a detent locking plunger that is disposed in an axially extending interior space of the body member in a manner enabling the locking plunger to be displaced within the body member between a first location, at which the locking plunger causes the detent balls to be locked in a position protruding from the body member, and a second location at which the locking plunger enables the detent balls to retract into the body member. The body member is provided with a sealed end having a key seat upon which a key may be seated for shifting the locking plunger between its first and second locations. The key is provided with at least one magnet that emanates a magnetic flux, and at least one second magnet is disposed in the interior space so as to emanate a magnetic flux which will interact with the flux of the magnet of the key when the key is seated on the key seat. Additional security is provided for preventing the unlocking of the magnetic lock by the mere positioning of the key on the key seat. Unlocking may occur only after a predetermined manipulation of the key means has been carried out on the key seat.

17 Claims, 3 Drawing Sheets

MAGNETIC LOCK

TECHNICAL FIELD

The present invention relates to locking devices which are magnetically actuated. In particular, to magnetic locks for use as security locks in applications where it is desired that the lock be pickproof and/or weatherproof, as well as for use in lock devices of any type and purpose, whether for decorative or security reasons, the provision of a small and innocuous key seat that is closed relative to the interior of the lock would be desirable.

BACKGROUND ART

Virtually all locking devices are subject to tampering, possibly resulting from loss of keys, duplication of keys, picking, etc. Furthermore, in many instances, locks are exposed to the environment and, as a result, can become contaminated or corroded. This leads to problems with the proper functioning of the lock which, in turn, results in the need for the lock to be replaced. An example of locks which are subject to these problems are barrel locks of the type conventionally used to secure utility meter boxes against tampering. Such barrel locks effect locking and unlocking by projecting and withdrawing small detent balls through recesses in a barrel-shaped body member of the lock via axial reciprocation of an internal plunger member. Examples of such locks can be found in Moberg, U.S. Pat. Nos. 3,033,016 and 4,015,456.

An example of one attempt that has been made to deal with the problems of tampering and contamination of barrel locks can be seen with reference to Skarzynski, et al., U.S. Pat. No. 4,107,959. The Skarzynski, et al. patent discloses a meter guard lock wherein the box is locked through the use of a conventional barrel lock which is inserted into its locking position through a locking tube. In order to protect the lock from dirt and weather, a plastic plug is inserted into the top end of the locking tube after the barrel lock has been secured in place. Furthermore, in order to deter tampering and efforts to pick the barrel lock, a conventional wire seal is threaded through a pair of diametrically opposed slots in the upper end of the locking tube and through a corresponding slot formed in the plastic plug. A comparable effort along these lines is also disclosed in Swisher, U.S. Pat. No. 4,262,946, wherein a non-removable plug is installed in the top end of the locking tube after the barrel lock has been secured in place, which plug cannot be removed without the plug being destroyed. However, the effectiveness of this approach is limited to the extent that a positive physical indication of tampering will be sufficient to discourage tampering with the lock. Furthermore, the use of such plugs is limited in applicability to barrel lock type locks and plugs are not feasible to use in locks that are required to be frequently locked and unlocked.

Many types of locking devices which are magnetically actuated or controlled are known. In most cases, these devices mimic conventional key-operated tumbler locks in design and operation, and thus suffer from the same types of drawbacks, e.g., they are easily picked and may become disabled from foreign matter entering into the key slot or from moisture-produced corrosion. However, magnetically operated locking devices are known, such as those of Miller, U.S. Pat. No. 4,022,038, and Hallmann, U.S. Pat. No. 3,782,147, that have a lock body and a magnet or a magnet carrying lock member that is displaceably positioned enclosed within an interior space of the body. In both of these patents, the locking device is operated by a key which is seated on a closed key seat (as opposed to within an open key slot) and magnets carried by the key, when properly aligned with the magnets within the lock body, cause a displacement of the internal magnets from a position securing a rotor shaft against rotation (locked position) into a position freeing the rotor shaft for rotational movement (unlocked position) via either the repulsive forces of the aligned magnets (Miller patent) or the attractive forces therebetween (Hallman patent). However, magnetic locks of these types are not readily adaptable to locks such as barrel locks which require axial shifting of a plunger as the means for triggering locking and unlocking, and the number of possible keying combinations is limited by the number of polarity variations for the given number of magnets used, on the one hand, while not being amenable to master keying, where such may be desirable, on the other hand.

Thus, there is a need for a magnetic lock that will be of a pickproof and weatherproof construction, but also have applicability to a wide range of lock types. Furthermore, it is needed to achieve a magnetic lock that not only provides virtually limitless combinations, but also is amenable to master keying.

SUMMARY OF THE INVENTION

In accordance with the foregoing, it is a primary object of the present invention to provide a magnetic lock which is sealed against foreign matter and moisture, having no key entry hole.

It is a further object of the present invention to provide a magnetic lock that is pickproof and provides virtually limitless key variations.

Yet another object in accordance with the present invention is to provide a magnetic lock that is adaptable to a wide range of known types of lock constructions without requiring significant changes to the lock mechanisms themselves.

A still further object in accordance with the present invention is to achieve all of the foregoing constructions in a lock of a basically simple design having few mechanical moving parts to wear or break.

These and other objects are achieved, in accordance with preferred embodiments of the present invention, by a magnetic lock which comprises a body member, detent means, and detent locking means that is disposed in an axially extending interior space of the body member in a manner enabling the locking means to be displaced within the body member between a first location, at which the locking means causes the detent means to be locked in a position protruding from the body member, and a second location, at which it enables the detent means to retract into the body member. The body member is provided with a sealed end having a key seat that is closed relative to the interior space and upon which a key means for shifting the locking means between the first and second locations within the body member may be seated. For producing an interaction between the key and the detent locking means within the body member, the key is provided with a first magnetic means that emanates a magnetic flux which will intersect the interior space when the key means is seated on the key seat, and wherein a second magnetic means is disposed in the interior space, so as to emanate a magnetic flux which will interact with the magnetic flux of the first magnet means when the key is seated on the key seat.

In addition to the security afforded by the ability to vary the number, polarity, position, and angling of the magnet means, additional security is afforded by the provision of a security means which serves for holding the locking means in one of the first and second locations, and for enabling it to shift to the other of said locations, under the effect of the interaction of the magnetic fluxes of the first and second magnet means, only after execution of a predetermined manipulation of the key means on the key seat. As a result, mere proper positioning of the key on the key seat does not result in unlocking of the magnetic lock, such occurring only after a predetermined manipulation of the key means has been carried out on the key seat.

In accordance with a specific feature of preferred embodiments of the present invention, the locking means comprises a plunger and the security means comprises a sleeve that is secured within the body member. By configuring of the sleeve relative to the plunger, a means is produced for causing the first magnet means, which is carried by the key, and the second magnet means, which is carried by the plunger, to switch into and out of magnetic attraction and repulsion modes in a predetermined manner, that is coordinated to the predetermined manipulation of the key, while guiding the plunger along a predetermined path of rotational and axial movement. It is because the magnetic lock in accordance with the present invention utilizes both magnetic attraction and repulsion modes to produce both axial and rotational movement of the locking means that, through variations in the positioning, angling, number and polarity of the first and second magnet means and the unlimited possibilities for configuring of the sleeve and plunger, enables virtually limitless keying combinations to be created (with or without master keying capabilities) which, in conjunction with the use of a closed key seat, provides a high degree of security. With regard to the latter point, it is noted that a magnetic lock in accordance with the present invention requires both possession of the correct key and knowledge of the correct pattern of manipulative movements in order to disengage the lock.

It is contemplated that, in accordance with the present invention, the magnetic lock can, itself, serve as a lock for a housing, cabinet, or the like in the manner of a barrel lock, for example, or, alternatively, the magnetic lock may be a part of a locking device, such as conventional door locks, padlocks, etc. This latter capability can be achieved by providing the locking device with an operating mechanism of a type wherein a manually turnable member turns a rotatable shaft which displaces a latch element via a linkage. With any locking device equipped with such an operating mechanism, the key can serve as the manually turnable member and the body member of the inventive magnetic lock can serve as the rotatable shaft. Thus, when the detent means is retracted the rotatable shaft will be disengaged from the linkage, and when the detent means is locked in a position protruding from the body member, the shaft is connected with the linkage. Accordingly, the locking device may be placed in either a locked or unlocked condition and secured in said condition by operating of the magnetic lock to disengage the detent means.

The above and other features, objects, and advantages of the present invention will become more apparent from the following description when taken in connection with the accompanying drawings which show, for purposes of illustration only, several embodiments in accordance with the present invention.

DETAILED DESCRIPTION OF THE PREFERRED EMBODIMENTS

Figure 5:
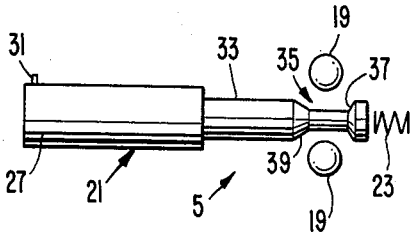
FIG. 5 is an exploded view of the moving components housed within the body member illustrated in FIG. 2.

The drawings show a key 1 and lock body member 3 which, together with the movable components 5 (shown in FIGS. 1, 2 and 5, respectively) form a preferred with the present invention. The magnetic lock 7 is directly usable, as is, in the manner of a conventional barrel lock of the type used to lock utility meters and the like. Inasmuch as the manner in which such barrel locks are used and the types of latches and housings into which such locks are insertable for securement are well known, no detailed discussion of such aspects need be provided herein.

Figure 2:
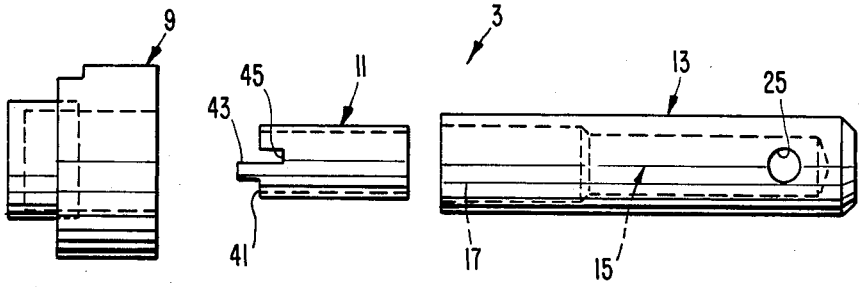
FIG. 2 is an exploded view of a body member of a magnetic lock in accordance with the present invention.
Figure 3:
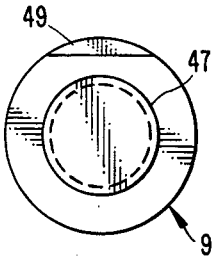
FIG. 3 is an end view of the body member of FIG. 2, showing a key seat for the key means of FIG. 1.
Figure 4:
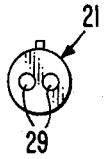
FIG. 4 is a top end view of a plunger forming a detent locking means of the magnetic lock in accordance with the present invention.

With reference to FIG. 2, it can be seen that the body member 3 has three major components, namely, a cap 9, a sleeve 11, and a barrel 13. Barrel 13 has an axially extending interior space 15 which has an enlarged open end portion 17 within which sleeve 11 is secured, such as by adhesive or by being force fit therein.

After installation of the sleeve 11, the movable components 5 are installed within the interior space 15. These movable components comprise detent means in the form of a pair of balls 19, detent locking means, in the form of a plunger 21, and biasing means for the plunger in the form of, for example, a coil spring 23.

As is conventional for barrel locks, bores 25 are disposed at opposite sides of the closed end portion of the barrel 13 and intersect the interior space 15. The balls 19 fit precisely, but movably, in the bores 25 and are held against outward dislodgement from the bores by, for example, peening or knicking the metal of the barrel in a well-known manner. Likewise, as is also conventional in barrel locks, plunger 21 is axially displaceable within the interior space 15 between a first location, whereat it causes the balls 19 to be locked in a position protruding from the barrel 13, and a second location, whereat it enables the ball means to retract into the body member. However, as will become more apparent, apart from such basic common attributes, the magnetic lock in accordance with the present invention departs significantly from conventional barrel locks which utilize a camming plunger that is mechanically manipulated by insertion of a key into the interior space of the barrel to grasp and pull the plunger rearwardly.

A first basic difference between the magnetic lock of the present invention and conventional barrel locks (apart from the fact that it is magnetically and not mechanically actuated), lies in the construction of the plunger 21, itself, as well as the use of sleeve 11 and cap 9. The plunger 21 is formed out of a Teflon-loaded, bearing grade thermoplastic that resists high and low temperatures, yet has a very low friction coefficient, or any other nonmagnetic material having a low coefficient friction additive to ensure that its motion is not impeded in any way, while also being unaffected by ambient elements of heat, cold, moisture, etc. Various materials qualify, and among them are titanium, ceramics, etc.

The plunger 21 has two sections, a first of which is a control section 27 within which magnet means, in the form of at least one magnet 29, is embedded, and a guide pin 31. The second portion of the plunger 21 is a cam portion 33 which extends axially from the inner end of control section 27. The diameter of cam portion 33 is coordinated to the size of the detent balls 19 and the diameter of the barrel 33 for causing the detent balls 19 to be locked in a position maximally protruding from the barrel 13. At an appropriate location along the length of cam portion 33, a pair of opposed ball receiving notches 35 are disposed. Notches 35 have a depth that permits the detent balls 19 to completely retract below the periphery of the barrel 13 when the notches 35 are aligned with the bores 25.

Notches 35 have axially sloping end walls 37, 39 to facilitate camming of the balls 19 out of the notches 35 onto the outer surface of the cam portion 33. By utilizing ball receiving notches instead of, as is conventional in barrel locks, a tapered plunger end portion, outward shifting of the balls 19 will be produced, whether the plunger 21 is retracted or forced inwardly from the position where notches 35 are aligned with the bores 25. The advantage of this characteristic is in that it enables unlocking to be produced by an inward displacement of the plunger, as opposed to the usual outward displacement, so that if someone attempts to defeat the lock by drilling or punching through the cap to force the plunger down, without properly orienting it, the result will be that the plunger merely jams the balls into the outwardly displaced locked position, i.e., forceful entry will permanently lock the lock.

While the motive force for controlling displacement of the plunger against the biasing force exerted by the spring 23 is supplied by magnetic flux interaction with the magnet means embedded in the control section 27 of the plunger 21, the sleeve 11 serves as a security means which defines the manner in which the plunger must be displaced in order to shift it from the location at which the balls 19 are locked in their position protruding from the bores 25 to the location at which the notches 35 are positioned and oriented in alignment with the bores 25 to enable the balls 19 to retract into barrel 13. In particular, with a sleeve as depicted in FIG. 2, in the locked position, the guide pin 31 rides on the top ledge 41 of guide sleeve 11. On the other hand, in a manner to be described in detail hereafter, under the effect of magnetic attractive forces, the plunger 21 can be rotated, for example, clockwise (for the specific sleeve illustrated) to bring the pin into abutment with a stop surface 43*a* of a projection 43, after which continued rotation will cause the magnetic attraction forces to be broken. Thus, the magnets can then be shifted into a repulsive mode in which the plunger 21, by action of magnetic repulsive forces, can be axially shifted inwardly until the pin 31 abuts the bottom of groove 45 in the sleeve 11, at which point the notches 35 will have been positioned in alignment with the bores 25.

Sleeve 11 is manufactured out of the same bearing grade of thermoplastic or other equivalent material as the plunger to tight tolerances, so that the fit of the plunger and sleeve will be very close, for purposes of ensuring proper orientation and ease of movement. It will also be appreciated that by appropriate design of the configuration of the sleeve 11 and by the number and placement of control pins, the nature and number of manipulations through which the plunger must be displaced, in order to shift it from its position locking balls 19 outwardly into its location freeing them for inward retraction, can be varied greatly. In this regard, it is noted that the plunger head can also be equipped with control recesses, pins, cams, etc. in addition to or instead of guide pin 31. Similarly, the sleeve 11 can be designed with key ways, grooves, spirals, notches, etc. to control and guide the movement of the plunger.

To produce the necessary predetermined manipulative sequence of movements required to displace plunger 21 into its position releasing the balls 19, the key 1 is provided. To provide a seat for the key 1, the cap 9 and the key 1 are provided with a matched configuration which will enable key 1 to securely sit upon the cap. These configurations may be varied from lock to lock or lock series to lock series to provide a means for limiting the interchangeability of keys from lock to lock, while, at the same time, providing a reference point for orienting of key 1 on the lock body member 3. As should be apparent, the possible configurations are limitless, and the seating configuration shown in the drawings, comprised of a circular centrally disposed male portion 47 and peripheral notch 49 are merely intended as examples. Coordinated to this key seat configuration, the stationary body portion 51 of key 1 is provided with a seating receptacle 53 that is matched to the male key seat portion 47 and an axial key projection 55 designed to sit in notch 49 when key seat portion 47 is seated within receptacle 53.

In order to hold key 1 on the key seat of the cap 9 during locking and unlocking, a standard O-ring 57 can be replaceably held within an annular groove in the interior wall surface of receptacle 53. Receptacle 53 is conveniently formed as a counter bore portion of a bore 61 that extends axially through the stationary key portion. Bore 61 is sized to closely receive a cylindrical mounting portion 63 of a manually manipulable key portion 65 of the key 1 with only enough clearance to facilitate free movement thereof. The manually manipulable key portion 65 also has a knurled knob 67 which is used to produce a rotational movement of key portion 65 within stationary body portion 51. In this regard, to prevent the manipulable key portion 65 from being pulled out of the stationary body portion 51, a set screw 69, having a spring biased retractable ball 71, is screwed into the threaded opening 73 of stationary body portion 51 sufficiently far as to cause the retaining ledge 75 of the manipulable key portion 65 to abut against it if an attempt is made to pull it outward from the bore 61. Furthermore, in order to provide a means to feel the degree to which the knob 67 has been turned, for example, on each half turn, the ball 71 seats in the end of a through hole 77, or in any number of recesses formed about the periphery of the neck portion 79. However, continued rotational force merely causes the ball 71 to deflect into the set screw 69 against the force of the biasing spring contained therein.

Figure 1:
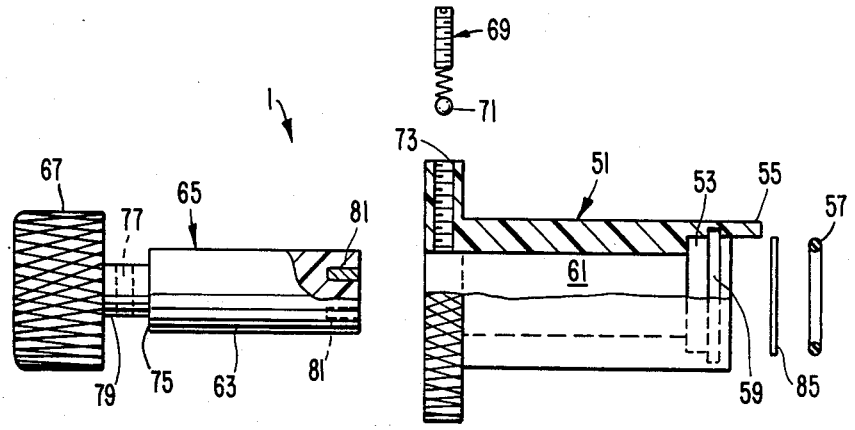
FIG. 1 is an exploded, partial sectional view of a key means of a magnetic lock in accordance with a first embodiment of the present invention.

Embedded in the end of the cylindrical mounting portion 63 are a plurality of magnets 81, for example, two as shown in FIG. 1. These magnets are sized, positioned, and matched in polarity to the magnets 29 embedded in the end of control portion 27 of the plunger 21. In this regard, it is noted that magnets retract and repel based upon polarity, so that if various combinations of north and south orientations are made, then only the right combination of north and south polarity will enable the force generated to be enough to overcome the spring tension of spring 23 and move the plunger 21. Thus, the size and number of magnets should be coordinated to the spring force, particularly in a way that will ensure sufficient magnetic force is applied only when the stationary body portion 51 is fully seated upon the key seat of the lock body member 3. In this regard, neodimium or somarium cobalt magnets are preferred since they are virtually impossible to demagnetize with conventional off-the-shelf demagnetizers, have high strength and operate well in a wide range of ambient temperatures.

At this point, it should be noted that in the attraction mode, the plunger can be moved right or left at will very controllably. However, in the repulsion mode, the plunger can only be pushed away and right and left movements cannot be readily controlled. That is, because the magnetic flux forces tend to push outwardly at an angle (i.e., the repelling force not only acts to push the plunger away, but also tends to rotate it in a manner acting to bring the opposite poles into confrontation), unless the opposing magnetic forces are in direct opposition, a repelled magnet will tend to run away on an angle from an opposing magnet. Thus, very fine tolerances must be maintained to ensure that the magnets 81 and the magnets 29 will be in direct opposition to each other, unless it is desired to incorporate any resulting rotative effect into the manipulation sequence or to design the sleeve configuration to counteract this rotative effect. Therefore, to more easily control vertical movement, it has been found to be advantageous to utilize more than one magnet to repel a plunger having a single magnet embedded therein. Such an embodiment is shown with reference to the modification of the manually manipulable key portion 65' depicted in FIGS. 6 and 7; although such a magnet orientation is equally usable in the initially described embodiment as well.

Figure 6:
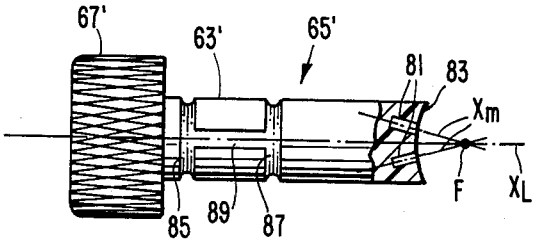
FIG. 6 is a modified manipulating key portion for use in the key means of FIG. 1.
Figure 7:
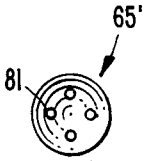
FIG. 7 is an elevational view of the right end of the manipulating key portion shown in FIG. 6.

As can be seen in FIGS. 6 and 7, for example, four magnets 81 can be embedded in a symmetrical array relative to a longitudinal center axis $X_L$ of the manipulable key portion 65' and are angled such that the magnetic flux paths of the magnets 81 all converge at a focal point F that is located on the longitudinal center axis $X_L$ at a point disposed outwardly and forwardly from the seating face 83 (formed by a disk of nonmetallic material secured at the bottom of seating receptacle 53), so as to be able to act along the longitudinal center axis of a plunger 21 that would be provided with only a single centrally disposed magnet 29 (not shown). Mounting of the magnets 81 within the cylindrical mounting portion 63' of the manipulable key portion 65' can be achieved with the necessary precision by incorporating the magnets into the mounting portion 63' during an injection molding manufacturing of the manipulable key portion 65'. Of course, if desired, a deliberate slight skewing of the axes $X_M$ can be produced so as to result in a skewing of the magnetic flux paths which will enable the plunger 21 to be aligned with and displaced into the slot 45 when the manipulating key portion 65' is rotated in one direction, e.g., counterclockwise, but not when rotated in the other direction.

Figure 9:
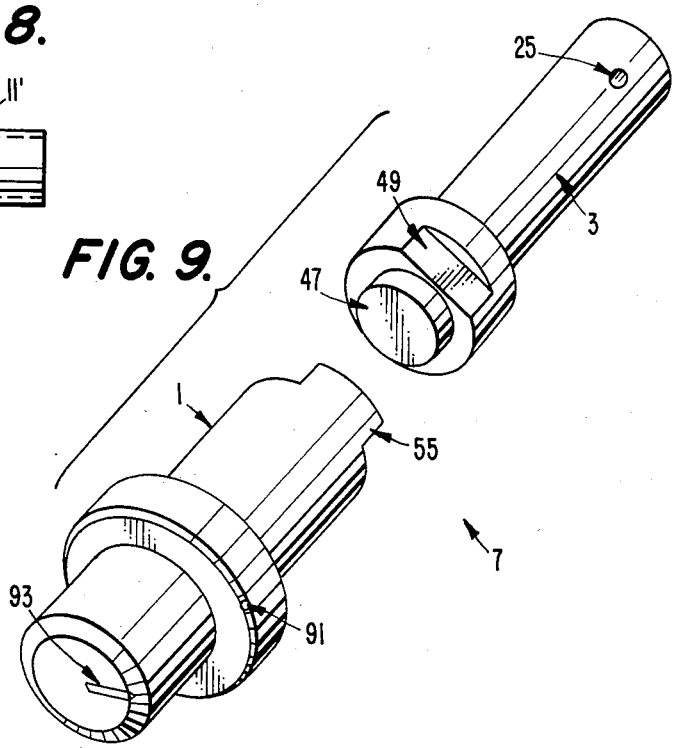
FIG. 9 is a perspective view showing a key means and body member, in accordance with the preferred embodiment, positioned in the orientation required for seating of the key means on the key seat of the body member.

In using the lock described so far, assuming the lock body member 3 is installed in place in a locked condition, the key 1 is oriented relative thereto in the manner shown in FIG. 9, and then the key 1 is moved axially toward the body member 1 until it is fully seated on cap 9, seating receptacle 53 and key projection 55 mating with male key seat portion 47 and key seat notch 49, respectively. At this point, a predetermined rotational manipulation of knob 67 will be executed to first bring the magnets 81 into attractive alignment with the magnets 29. For example, by a counterclockwise rotation of knob 67 more than 360 degrees, regardless of the location of guide pin 31, the plunger will be rotated sufficiently to cause guide pin 31 to abut the opposite side of sleeve projection 43 from the stop surface **43*a*. Once the plunger 21 has been placed in a definite rotational position by such a rotation, those knowing it can rotate the knob 67 to a position placing magnets 81 in attractive opposition to the magnets 29. After placing the magnets 81, 29 in attractive alignment, knob 67 is rotated clockwise (for the sleeve 11 shown) a sufficient amount to continue beyond the point at which the plunger abuts stop surface 43*a* (at which point the attraction mode is broken) until the manipulable key portion 65 is brought into the proper location to place magnets 81 in repulsing opposition to magnet 29. Since the guide pin is situated above slot 45, the magnetic repulsing forces can be used to drive plunger 21 downwardly into interior space 15, against the force of spring 23, until guide pin 21 reaches the bottom of slot 45. As a result, notches 35 are thereby shifted into alignment with balls 19, so that balls 19 may retract into bores 25, unlocking lock 7** and enabling its removal.

Figure 8:
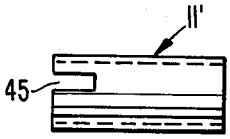
FIG. 8 is a side elevational view of a modified sleeve for use in the body member shown in FIG. 2 when the manipulating key portion of FIG. 6 is utilized in the key means of FIG. 1.

In accordance with another feature of the manipulable key portion 65', the cylindrical mounting portion 63' is provided with a pair of circumferential groove tracks 85, 87 that are interconnected by axial groove tracks 89 (only one of which is shown) and along which the ball 71 of the set screw 69 is able to travel in circumferential and longitudinal directions, respectively, during manipulation of the knob 67'. With such a construction of the manipulable key portion 65', the projection 43 can be dispensed with (as shown in FIG. 8 for the sleeve 11') as a means to break the magnetic attraction between the magnets of the key 1 and that of the lock body member 3. That is, with a manipulable key portion 65', after seating key 1 on cap 9, with manipulable key portion 65' fully inserted into bore 61 of stationary body portion 51 (in which position ball 71 is in track 85), the knob 67' is rotated in order to bring the guide pin 31 into a position of alignment directly above the slot 45. Then, the knob 67' is pulled to cause the ball 71 to travel from the track 85, down the track 89 to the track 87 (a manipulation which will be possible, although requiring greater force even if the knob has not been manipulated into the proper location). When the knob 67 has been pulled out sufficiently to reach track 87, the distance of magnets 81' from plunger 29 will be great enough to cause the magnetic attractive forces between the magnets of the key 1 and that of lock body member 3 to be broken. Thereafter, the knob 67' can be rotated so as to change the polarity relationship between the magnets 81 and that of the plunger 21. Then, by pushing knob 67' back in (assuming the knob has been rotated to the proper location), the ball 71 will travel down a second axial groove track 89 (not shown), thereby returning it to the groove track 85. This having been done, by rotation of the knob 67' to the proper position, the magnets of the manipulable key portion 65' will be brought into a repelling polarity alignment relative to the magnet of the plunger 21. As a result, the plunger 21 will be propelled down into the interior space 15 until the guide pin 31 bottoms in the recess 45, under the magnetic repulsive forces of the opposed magnets. In this regard, if the above-mentioned skewed orientation is utilized, should the knob be rotated in the wrong direction, the plunger will not go down the slot 45, but rather will be rotationally displaced away from the slot 45.

It can be appreciated that, with either manipulable key portion 65 or 65', the key 1 enables the lock 7 to function in the manner of a combination lock. As a result, it is necessary to provide one or more rotational location reference point indicators 91 on the stationary key portion and an indicator guide 93 upon the knob of the manipulable key portion 65, 65' (see FIG. 9).

While the magnetic lock, as described so far, may serve as a locking device by itself, it is also contemplated that the magnetic lock 7 serve as only a part of a locking device of an otherwise conventional construction. In particular, conventional lock mechanisms, too numerous to mention specifically, are operated by rotation of a rotatable shaft causing a latch element to be displaced via a linkage, such being commonly found, for example, on doorknob latch mechanisms, deadbolt locks, safes, etc. Furthermore, it is also known to provide a means for disabling a lock mechanism through the use of an axially displaceable plunger and detent balls to create a holdback lock (see, e.g., U.S. Pat. No. 3,261,630) or a handle clutch (see, for example, Welch U.S. Pat. No. 3,314,708). In a comparable manner, as described below with reference to FIGS. 10–13, the magnetic lock of the present invention can be used to disable any conventional locking mechanism, that is operated by rotation of a rotatable shaft, by disengaging the shaft from the operating mechanism of the locking device to thereby prevent it from being shifted to an unlocked condition without proper use of the key 1.

Figure 10:
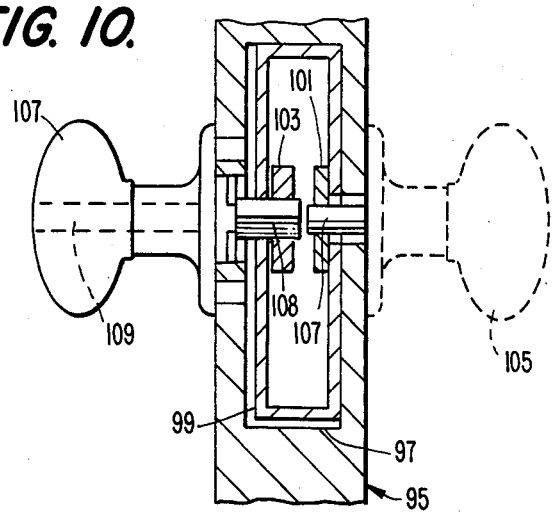
FIG. 10 shows a locking device into which a magnetic lock in accordance with the present invention has been incorporated.

Use of the magnetic lock in accordance with the present invention as part of a locking device of a type having an operating mechanism that is actuated by rotation of a rotatable shaft, by a manually turnable member, to displace a latch element via a linkage, will now be described with reference to FIGS. 10–13. In FIG. 10, a portion of a door 95 is shown, within which a mortise 97 has been formed and within which a conventional door latch locking device 99 is mounted. The locking device 99 includes a casing which houses a conventional lock operating mechanism that is comprised of linkage elements 101, 103 which are used to roll back the door latch (not shown). At one side of the door 95, a conventional doorknob 105 is mounted which can be used to roll back the door latch, via the linkage element 101, by causing the rotatable shaft 107 to rotate in accordance with the normal operation of the conventional locking device 99 and such, by itself, forms no part of the present invention. On the other hand, the linkage element 103 for releasing of the door latch from the opposite side of door 95 is produced by rotation of a shaft 108 that has mounted therein a lock body member corresponding to body member 3 (see FIG. 11). However, in this case, a doorknob 107 is attached to the cap 9, the key seat of which is disposed within an axial bore 109 of the doorknob 107. Thus, the key 1 is inserted into the bore 109 in order to engage the key seat 9 for acting upon the plunger 21, in the manner described above. Further, an alternative embodiment is to locate the key seat, FIG. 9, on the surface of knob, FIG. 107, in a decorative or logo type configuration. This provides for a door mechanism that is attractive and functional yet appears not to have a security means.

Figure 11:
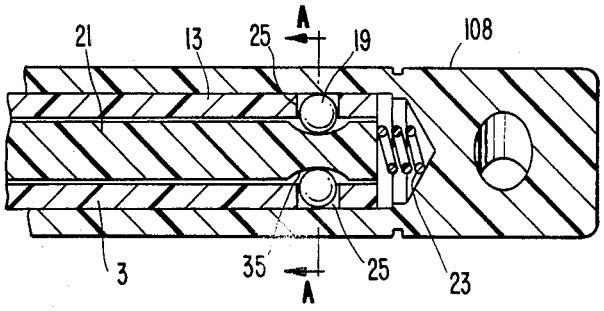
FIG. 11 is a partial sectional view showing the positioning of an end of the body member of the magnetic lock of the present invention within a rotatable shaft of the operating mechanism of the locking device of FIG. 10.
Figure 12:
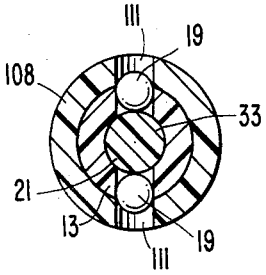
FIGS. 12 and 13 are sectional views taken along lines A—A of FIG. 11, but FIG. 12 showing the components in their positions occurring when the magnetic lock is connected to the rotatable shaft of the operating mechanism of the locking device.
Figure 13:
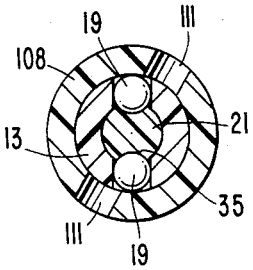

As can be seen from FIGS. 11 and 13, in this case, with the magnetic lock in its locked condition, the balls 119 are free to retract inwardly into the bores 25 of the barrel 13 (which is the opposite circumstance from that which occurs when the magnetic lock is used by itself, for example as a barrel lock). Thus, with the magnetic lock in such a state, rotation of the doorknob 107 will produce no rotation of the rotatable shaft 108, but rather the barrel 13 of the body member 3 will be caused to rotate relative to the shaft 108 out of its position wherein the bores 25 are aligned with the apertures 111 in the shaft 108 (FIG. 13). Thus, the latch of the locking device 99 will not be rolled back and the door cannot be opened.

On the other hand, if the correct key 1 is inserted into the bore 109 and the appropriate combination of manipulations executed, the plunger 21 will be shifted axially relative to the balls 19, so that the ball, receiving notches 35, are no longer aligned with the balls 19 and, thus, will be forced outwardly into the bores 111 of the shaft 108. At this point, if the doorknob 107 is rotated so as to rotate barrel 13, balls 19 will cause the shaft 108 to rotate along with the barrel 13, thereby operating the linkage element 103 of the locking device 99 to roll back the door latch. It should be appreciated that those of ordinary skill in the art will know how the magnetic lock in accordance with the present invention can be incorporated, in a manner analogous to that described with respect to FIG. 10, into numerous other locking devices of similar or different types, including padlocks, deadbolt locks, etc.

In addition to the features described above, numerous other modifications should be apparent to those of ordinary skill in the art. For example, while the use of a sleeve 11, 11' for defining the types of manipulations necessary to produce a locking movement has been described (because such is the preferred means for implementing this aspect from a standpoint of ease of manufacture), it should be appreciated that the equivalent effect could be produced by machining of ledges, grooves, recesses, and the like, directly into the interior surface of the barrel 13 defining end 17 of interior space 15. Furthermore, while an operation of the magnetic lock has been described where repulsive forces are utilized to produce an unlocking movement by inward displacement of the plunger 21 against the compression spring 23, it should be appreciated that the reverse operation could be achieved so that the unlocking movement is produced under the action of the force of spring 23. For example, this result is producible by reversing the direction of insertion of the sleeve 11, 11', and axially displacing the location at which the guidepin 31 is placed, from the position shown, toward the cam portion 33 to a location corresponding to that of the machined surface feature it is to ride on.

It is also contemplated that, to increase the difficulty of drilling or punching through the end cap 9, instead of using a configuration having a flat seating surface, as on male key seat portion 47, a convexly domed one could be provided. Similarly, to improve the ability of the plunger 21 to rotate, in its position biased outwardly (by the spring 23) into engagement with the interior of the cap 9, the interior of the cap can also be convexly or conically domed to minimize contact between the interior of the cap 9 and the end of the plunger 21.

It also should be apparent from the foregoing that, by merely changing sleeves 11, the same basic components can provide numerous different locking combinations, all of which can be operated by a single master key or, by modifying any or all of the key seating configuration, numbers of magnets, magnet polarity, magnet angling, and magnet position, numerous different and incompatible locks can be produced, all of which are operable by the same combination of manipulations. Thus, a magnetic lock, or a locking device incorporating same, in accordance with the present invention, not only possesses a high degree of security, but also provides virtually limitless possible keying combinations that may be master keyed or not, as desired.

Likewise, it should be apparent that the number of possible uses for a magnetic lock in accordance with the present invention in otherwise conventional lock applications is also virtually limitless without having to make major changes to the basic operation of any such conventional lock. Furthermore, by eliminating the presence of movable parts that are exposed to the elements, a lock in accordance with the present invention is not subject to damage by being jammed with foreign matter, nor is it subject to the effects of corrosion resulting from exposure to moisture. Additionally, the closed cap, which is amenable to any design configuration imaginable, can facilitate camouflaging of the existence of a lock or may simply give the lock a more decorative appearance.

Accordingly, while I have shown and described various embodiments and the advantages thereof in accordance with the present invention, it should be understood that the invention is not limited thereto, but rather possesses numerous other advantages and is susceptible of numerous other changes in modification as will be known to those of ordinary skill in the art, and I, therefore, do not wish to be limited to the details shown and described herein, but intend to cover all such changes and modifications as are encompassed by the scope of the appended claims.

I claim:

1. A magnetic lock comprising a body member, detent means, detent locking means disposed in an axially extending interior space of the body member in a manner enabling said locking means to be displaced within the body member between a first location causing said detent means to be locked in a position protruding from said body member and a second location enabling said detent means to retract into said body member, and key means for shifting said locking means between said first and second locations within said body member; said body member including a sealed end having a key seat that is closed relative to said interior space; said key means is configured for seating on said key seat and contains a first magnet means for emanating a magnetic flux which will intersect said interior space when the key means is seated on said key seat; a second magnetic means disposed in said interior space for emanating a magnetic flux which will interact with the magnetic flux of said first magnet means when the key means is seated on the key seat; and security means for holding said locking means in one of said first and second locations and for enabling said locking means to shift to the other of said first and second locations under the effect of the interaction of the magnetic fluxes of said first and second magnet means only after execution of a predetermined manipulation of said key means on said key seat.

2. A magnetic lock according to claim 1, wherein each of said first and second magnet means comprises a plurality of magnets carried by said key means and at least one magnet carried by said locking means, respectively.

3. A magnetic lock according to claim 2, wherein said locking means comprises a plunger.

4. A magnetic lock according to claim 3, wherein said security means comprises a sleeve secured within said body member, said sleeve and plunger being configured relative to each other to form a means for causing said first and second magnets to be switched into a predetermined manner coordinated to and caused by said predetermined manipulation of said key means and to form a means for guiding said plunger along a predetermined path of rotational and axial movement.

5. A magnetic lock according to claim 4, wherein said one location in which said security means holds said locking means is said first location, and said other location to which said security means enables said locking means to shift is said second location.

6. A magnetic lock according to claim 5, wherein said magnetic lock is a barrel lock, said body member comprising the barrel of said barrel lock.

7. A magnetic lock according to claim 4, wherein said one location in which said security means holds said locking means is said second position, and said other position to which said security means is shiftable is said first location.

8. A magnetic lock according to claim 7, wherein said magnetic lock is part of a locking device of a type having an operating mechanism that is actuated by rotation of a rotatable shaft, by a manually turnable member, to displace a latch element via a linkage, wherein said body member serves as a means for engaging and disengaging said manually turnable member relative to said rotatable shaft, said rotatable shaft being disengaged when said detent means is retracted and being engaged when said detent means is locked in said position protruding from the body member.

9. A magnetic lock according to claim 2, wherein said plurality of magnets carried by said key means are symmetrically disposed relative to a longitudinal center axis of the key means.

10. A magnetic lock according to claim 9, wherein said plurality of magnets carried by said key means are mounted at angles which cause their magnetic flux paths to converge at said longitudinal center axis, axially outwardly from a seating portion of the key means.

11. A magnetic lock according to claim 4, wherein said key means comprises a stationary portion for seating of said key seat and a manually manipulable portion that is at least rotationally displaceable relative to said stationary portion on said key seat, said first magnet means being carried by said manipulable portion.

12. A magnetic lock according to claim 11, wherein said manipulable portion of the key means is only rotationally displaceable relative to said stationary portion and said sleeve is provided with means for terminating said attraction mode by rotation of said manipulable portion.

13. A magnetic lock according to claim 11, wherein said manipulable portion is axially and rotationally displaceable relative to said stationary portion on said key seat, said first magnet means being able to interact with said second magnet means in a first axial position of said manipulable portion relative to the stationary portion but being displaced out of an interactive range of said first and second magnet means in a second axial position.

14. A magnetic lock according to claim 3, wherein said security means comprises a means for causing said first and second magnets to be switched into and out of magnetic attraction and repulsion modes in a predetermined manner coordinated to and caused by said predetermined manipulation of said key means and to form a means for guiding said plunger along a predetermined path of rotational and axial movement.

15. A magnetic lock according to claim 14, wherein said key means comprises a stationary portion for seating of said key seat and a manually manipulable portion that is at least rotationally displaceable relative to said stationary portion on said key seat, said first magnet means being carried by said manipulable portion.

16. A magnetic lock according to claim 15, wherein said manipulable portion of the key means is only rotationally displaceable relative to said stationary portion and said sleeve is provided with means for terminating said attraction mode by rotation of said manipulable portion.

17. A magnetic lock according to claim 15, wherein said manipulable portion is axially and rotationally displaceable relative to said stationary portion on said key seat, said first magnet means being able to interact with said second magnet means in a first axial position of said manipulable portion relative to the stationary portion but being displaced out of an interactive range of said first and second magnet means in a second axial position.

* * * * *